US005143281A

United States Patent [19]

Mainz et al.

[11] Patent Number: 5,143,281

[45] Date of Patent: Sep. 1, 1992

[54] FOLDING BOX PACKAGE OF A LIQUID-TIGHT, HEAT SEALABLY COATED COMPOSITE CARDBOARD MATERIAL, MORE PARTICULARLY A FOIL MOUNTED COMPOSITE CARDBOARD MATERIAL

[75] Inventors: Hans-Willi Mainz, Heinsberg-Karken; Lutz Schneider, Hückelhoven, both of Fed. Rep. of Germany

[73] Assignee: PKL Verpackungssysteme GmbH, Linnich, Fed. Rep. of Germany

[21] Appl. No.: 805,453

[22] Filed: Dec. 10, 1991

[30] Foreign Application Priority Data

Jan. 24, 1991 [DE] Fed. Rep. of Germany ..... 4102021

[51] Int. Cl.[5] ..... B65D 5/40

[52] U.S. Cl. ..... 229/132; 229/3.1; 229/137; 229/134; 493/133; 493/326; 493/327

[58] Field of Search ..... 229/3.1, 132, 134, 137, 229/184; 156/227, 252, 257; 493/326, 327, 133

[56] References Cited

U.S. PATENT DOCUMENTS

| | | | |
|---|---|---|---|
| 1,698,699 | 1/1929 | Andrews | 229/134 |
| 3,120,335 | 2/1964 | Egleston et al. | 229/184 |
| 3,194,474 | 7/1965 | Rumberger | 229/134 |
| 3,326,708 | 6/1967 | Hawkins | 229/134 |
| 3,367,556 | 2/1968 | Whitby | 229/134 |
| 3,388,639 | 6/1968 | Rumberger | 493/129 |
| 4,508,226 | 4/1985 | Davis et al. | 229/132 |
| 4,684,058 | 8/1987 | Weber | 229/134 |
| 4,828,539 | 5/1989 | Jonsson et al. | 493/403 |

FOREIGN PATENT DOCUMENTS 0027668 10/1980 European Pat. Off. .

*Primary Examiner*—Gary E. Elkins

*Attorney, Agent, or Firm*—Marmorek, Guttman & Rubenstein

[57] ABSTRACT

The invention relates to a folding box of composite cardboard material coated heat sealably at least on the inside, which has a flat bottom to which two pairs of opposite triangular folding pockets are sealed lying flat. To prevent bubble formation on the inside of the package, more particularly those areas of the triangular folding pockets which are to be sealed to one another over their complete surface, due to steam forming in the composite cardboard material during the heat activation of the areas, the heat sealable coating is perforated right into the cardboard in the areas.

5 Claims, 4 Drawing Sheets

Figure 1A:
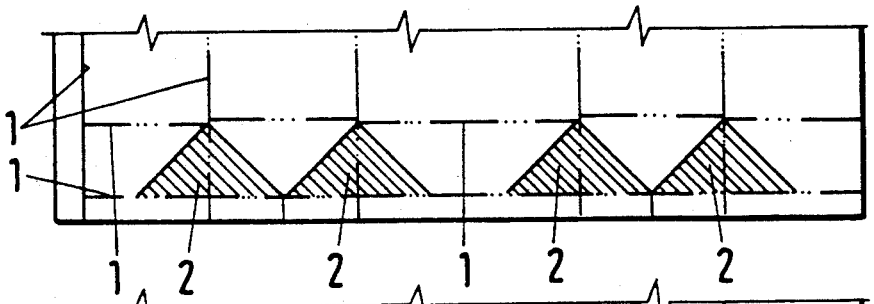

Fig.4f
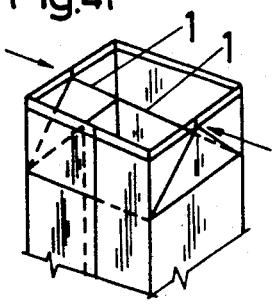
Fig.4g'
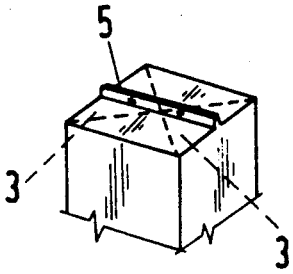
Fig.4h
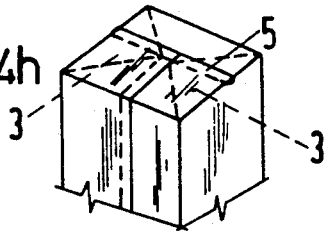
Fig 4h'
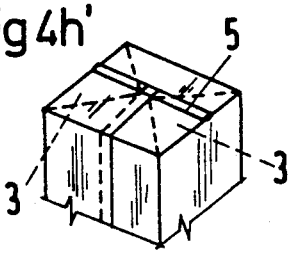
Fig.5f
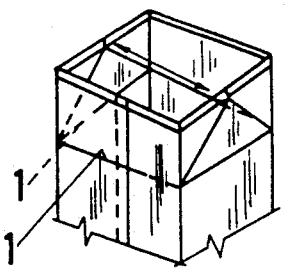
Fig.5g
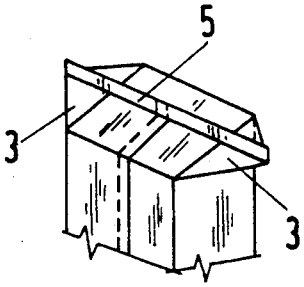
Fig.5h
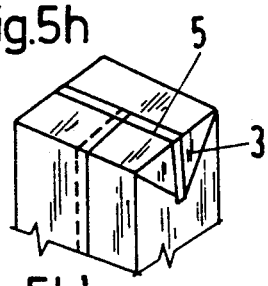
Fig 5h'
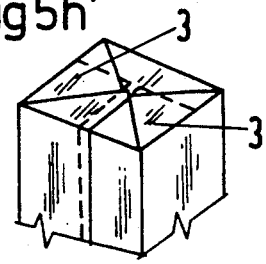
Fig.6f
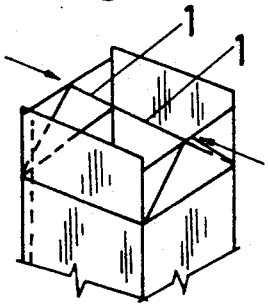
Fig.6h
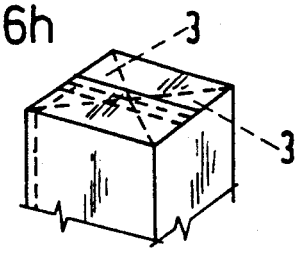
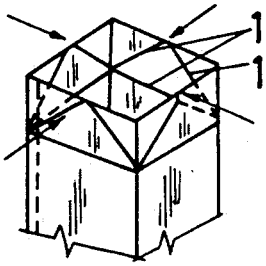
Fig.7f
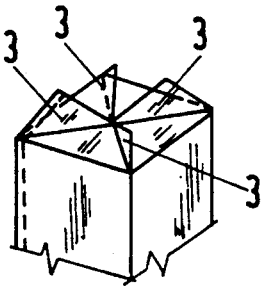
Fig.7g
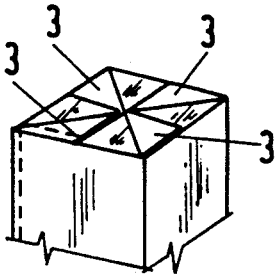
Fig.7h

FOLDING BOX PACKAGE OF A LIQUID-TIGHT, HEAT SEALABLY COATED COMPOSITE CARDBOARD MATERIAL, MORE PARTICULARLY A FOIL MOUNTED COMPOSITE CARDBOARD MATERIAL

The invention relates to a folding box package of a liquid-tight composite cardboard material, more particularly a foil mounted composite cardboard material heat sealably coated on at least the inside, said package having a flat bottom folded-on in one piece and closed by at least one seam, more particularly a web seam, applied flat thereagainst, and two pairs of opposite triangular folding pockets lying flat and sealed over their complete surface.

Folding box packages of the kind specified are known which have differently constructed bottoms (DT 25 20 401 C2; EP 0093 849 A2; EP 0 133 863 B1). Those folding boxes are produced from a blank or a roll of material for a jacket, the hot sealing of the bottom being performed by ultrasonics, induction, heat pulse, infrared radiation or hot air. Normally, if such folding box packages are intended for the aseptic packaging of goods, prior to filling, a liquid or vaporous sterilizing medium is played on the complete surface of the inside of the packings. The sterilizing medium must subsequently be completely removed from the packing. To enable this to be done, the triangular folding pockets must be sealed over their complete area, to prevent accumulations in the packing. The sealing can be most satisfactorily performed by infrared radiation or hot air. Due to the melting point of the heat sealable coating, which is clearly above 100° C., the zones to be sealed to one another must be played on with hot air well above 100° C. The hot air activation of the zones to be sealed to one another has shown that bubble formation causing the risk of leakages takes place on the heat-activated inside of the composite cardboard material. This fact is more particularly noticeable in the case of composite cardboard material foil mounted on the inside, since in that case the bubbles are displaced, so that more leakages take place in the package bottom during sealing. It was found that bubble formation takes place particularly heavily in the inner areas—i.e., the areas lying at a distance from the cut edges—and less heavily in the outer areas, namely the areas adjoining the cut edges. It was also found that the extent of such faults can be kept small if operations are performed with as low an activation temperature as possible. However, a low activation temperature makes it more difficult to seal the activated areas over their complete surface.

To keep the number of faults during hot sealing as small as possible, while at the same time ensuring that the activated zones are sealed over their complete surface, operations can be performed with a relatively high activation temperature, at which bubble formation does not quite take place, on condition that the activation temperature can be maintained within narrow tolerances. However, the maintenance of such tolerances makes production more expensive.

It is an object of the invention to provide a package of the kind specified wherein bubbles are not formed on the inside of the cardboard material during the heat activation of the bottom, even if activation is performed at a higher temperature than that absolutely necessary for the hot sealing.

This problem is solved according to the invention in a folding box package of the kind specified by the feature that at least the inside heat sealable coating of the areas to be sealed is perforated right into the cardboard. More particularly, the inner areas of the triangular folding pockets are so perforated, that preferably the outer areas adjoining the inner areas should also be perforated.

The invention is based on the knowledge that the bubble formation is due to humidity, which is present in the composite cardboard material and which, more particularly with an activation temperature well above 100° C., so increases the vapour pressure in the cardboard material that with a dense outer coating, as, for example, with a cardboard coated on the outside for purposes of printing or with a cardboard coated on both sides, steam escapes in the direction of the inside of the composite, where it causes bubble formation and leakages. The bubble formation affects more particularly the inner areas—i.e., the large-surface zones to be activated, which are not directly bounded by a cut edge, while the outer areas namely the zones to be activated which lie directly at a cut edge, are clearly less affected by bubble formation, and not at all if correspondingly narrow outer areas extend parallel with and adjoining the cut edge, since in the case of such outer areas the steam can escape via the open cut edges. In general, with the invention no such steam pressure can build up, since the steam forming during the heat activation of the areas can escape outwards via the perforation, which is of course at first open. The activation temperature is non-critical—i.e., there is no need to maintain the temperature within narrow limits. Tests have shown that no bubble formation takes place on the inside of the composite cardboard material if the activation temperature even goes more than 15° C. above the present-day conventional activation temperature of, for example 360° C. The perforation on the finished package does not adversely affect its use, since the perforation can be so selected that it is folded in and sealed in, and therefore the perforation is protected against dirt, nor can any humidity penetrate into the composite material via the perforation.

If required, for example, if the composite cardboard material comprises coated cardboard and/or the inner or outer coating has only slight adhesion to the cardboard, it may be advantageous also to perforate the outside of the composite material in the zone of the areas to be sealed in right into the cardboard, to prevent bubble formation on the outside also.

The invention will now be described in greater detail with reference to drawings, which illustrate the blank and the bottom of a folding box package with web seam as representing the different kinds of folding box packages specified hereinbefore, to which the invention extends. The hatched areas represent the areas to be heat activated.

Figure 1B:
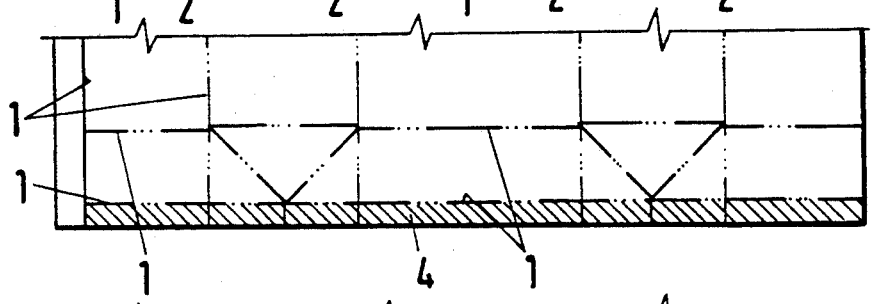
Figure 1C:
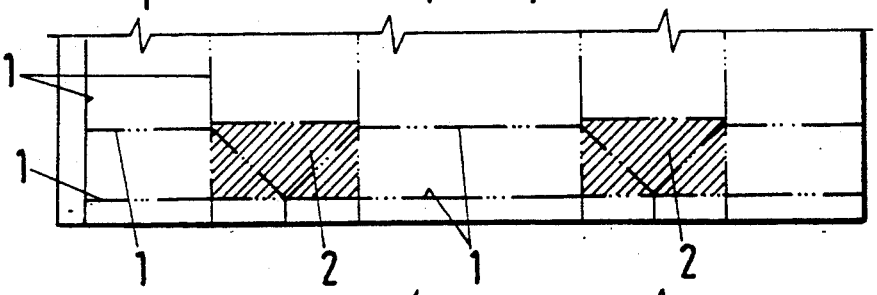
Figure 1D:
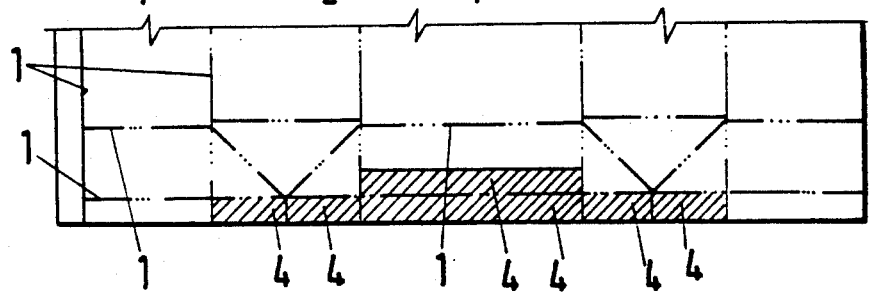
Figure 1E:
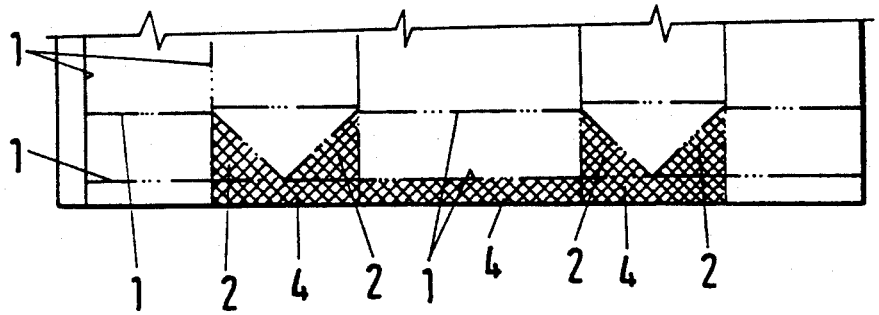
Figure 2A:
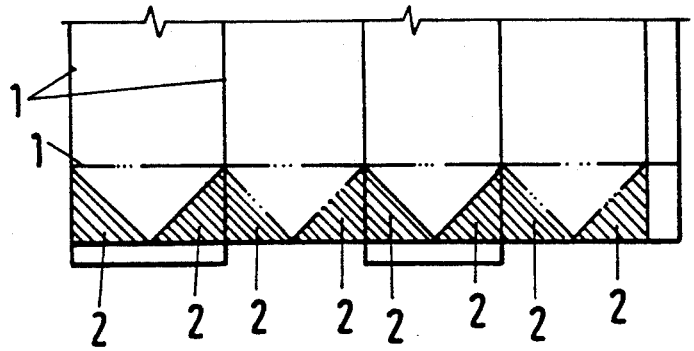
Figure 2B:
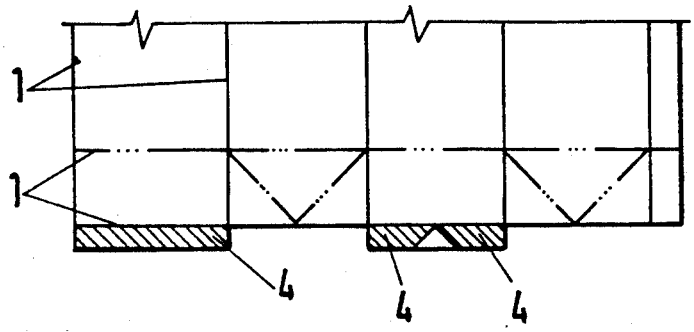
Figure 2C:
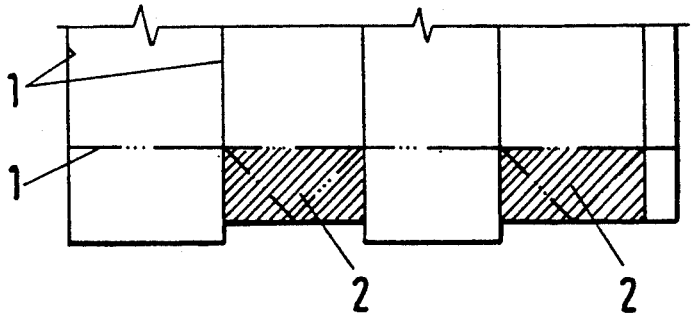
Figure 2D:
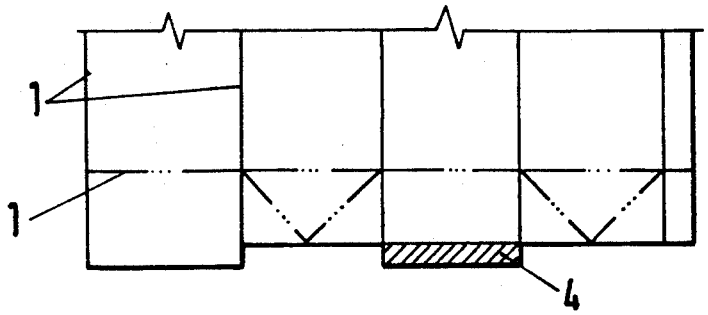
Figure 2E:
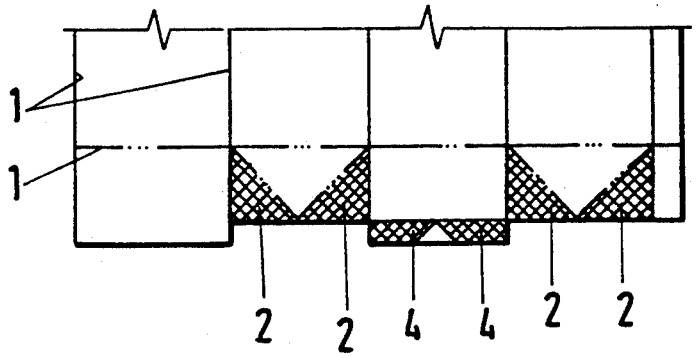
Figure 3A:
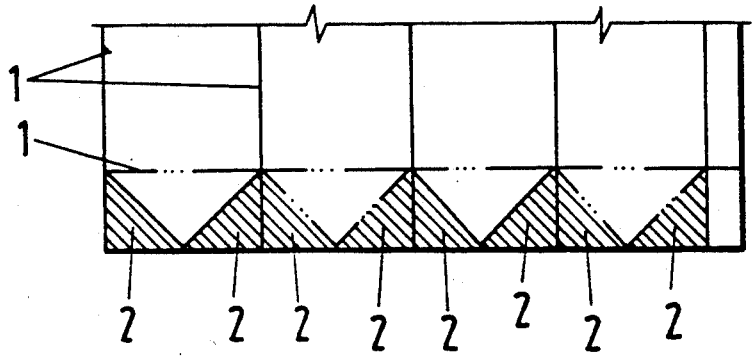
Figure 3C:
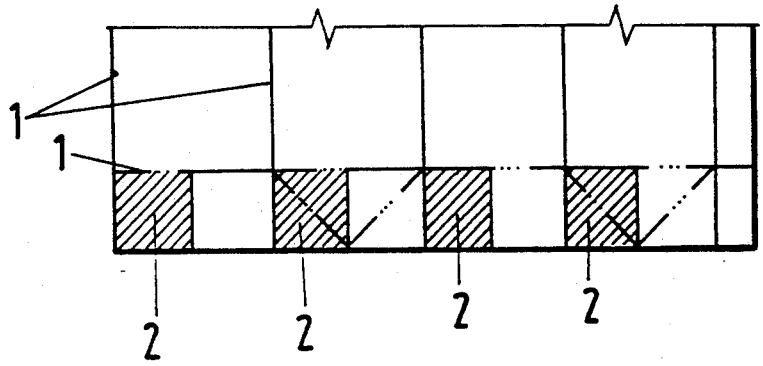
Figure 3E:
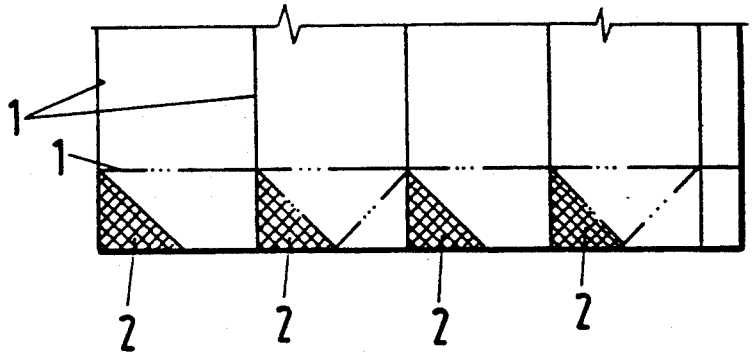

In the drawings:

FIG. 1*a* is a detail of a blank for the bottom showing hatched inside inner areas of triangular folding pockets, FIG. 1*b* shows the blank illustrated in FIG. 1*a* having hatched inside outer areas for the web seam, FIG. 1*c* shows the blank illustrated in FIG. 1*a* having hatched outside inner areas in the zone of the triangular folding pockets, FIG. 1*d* shows the blank illustrated in FIG. 1*a* having hatched outside outer areas in the zone of the web seam, FIG. 1*e* shows the blank illustrated in FIG. 1*a* having hatched inner and outer areas which are heat activated on both the inside and the outside, FIGS. 2*a*, 2*b*, 2*c*, 2*d*, and 2*e* show another blanks having an area subdivision as illustrated in FIGS. 1*a* to 1*e*, prior to the folding of the bottom, FIGS. 3*a*, 3*c*, and 3*e* show further blanks having an area subdivision as illustrated in FIGS. 1, 1*c* and 1*e*, FIGS. 4*f*, 4*g'*, 4*h*, 4*h'*, 5*f*, 5*g*, 5*h*, and 5*h'* show folding box packages made from the blanks illustrated in FIGS. 1*a* to 1*e*, FIGS. 6*f* and 6*h* show a folding box package made from the blank illustrated in FIGS. 2*a* to 2*e*, and FIG. 7*f*, 7*g*, and 7*h* a folding box package made from the blank illustrated in FIGS. 3*a* to 3*e*.

Referring to FIGS. 1*a* to 1*e*, a rectangular blank for a parallelipipedic folding box package consists of a composite cardboard material which is foil mounted on the inside of the package and bears a heat sealable plastics coating (PE) on the inside and outside. Prior to the forming of the folding box package, the blank is provided with folding lines 1, as shown in the drawings. On the inside the heat sealable coating and the aluminium foil are perforated at least in the inner areas 2, shown hatched in FIG. 1*a*, for the formation of triangular folding pockets 3, but preferably also in the outer areas 4, shown hatched in FIG. 1*b*, for a web seam 5. When the outside is densely coated, the composite material is also perforated from the outside in the inner areas 2, shown hatched in FIG. 1*c*, and the outer areas 4, shown hatched in FIG. 1*d*. FIG. 1*e* shows the bottom zone of blanks having the inner and outer areas 2, 4 to be activated on both sides for bottom sealing.

FIGS. 2*a* to 2*e* and 3*a* to 3*e* show different kinds of other embodiments of blanks for folding box packages having an area subdivision corresponding to that shown in FIG. 1.

FIGS. 4 to 7 show the bottom area of the various blanks at the individual production steps. FIGS. 4 and 5 correspond to the blank illustrated in FIG. 1, FIG. 6 to the blank illustrated in FIG. 2, and FIG. 7 to the blank illustrated in FIG. 3. The blank thus prepared is first shaped into a hose of rectangular cross-section, as shown in FIGS. 4*f*, 5*f*, 6*f* and 7*f*, which show the bottom zone in the activation position. Then the areas of the bottom shown hatched in FIGS. 1 to 3 are activated and the bottom is formed by folding in the direction indicated by the arrows in FIGS. 4*f*, 5*f*, 6*f* and 7*f*. As a result the triangular folding pockets are formed, as shown in FIGS. 4*g* , 5*g* and 7*g*, and the zones shown hatched are folded in in the bottom of the package and if necessary sealed in flat, so that they are covered in the direction of both the inside and the outside of the package. FIG. 4*a* shows the finished bottom of a blank as illustrated in FIGS. 1*a* to 1*e*, FIG. 4*h'* shows the finished bottom of a blank as illustrated in FIGS. 1*b* or 1*d*, FIGS. 5*h* and 5*h'* show the finished bottom of a blank as illustrated in FIG. 1*b*, FIG. 6*h* shows the finished bottom of a blank as illustrated in FIGS. 2*a* to 2*e*, and FIG. 7*h* shows the finished bottom of a blank as illustrated in FIGS. 3*a* to 3*e*. In FIG. 5*h* the triangular folding pockets 3 are shown folded laterally outwards and in FIG. 5*h'* folded on to the bottom of the package.

Clearly, the kind of blank shown in FIGS. 3 and FIG. 7 respectively will be used only in the case of a folding box package having a square bottom surface.

We claim:

1. A folding box package of a liquid-tight composite cardboard material, more particularly a foil mounted composite cardboard material heat sealably coated on at least the inside, said package having a flat bottom folded-on in one piece and closed by at least one seam, more particularly a web seam (5), applied flat thereagainst, and two pairs of opposite triangular folding pockets (3) lying flat and sealed over their complete surface, characterized in that at least the inside heat sealable coating of the areas (2, 4) to be sealed is perforated right into the cardboard.

2. A folding box package according to claim 1, characterized in that the inside heat sealable coating of the inner areas (2) forming the triangular folding packets (3) is perforated right into the cardboard.

3. A folding box package according to claim 2, characterized in that the hot sealable coating of the outer areas (4) adjoining the inner areas (2) is perforated right into the cardboard.

4. A folding box package according to claim 1, characterized in that the perforation is a needle perforation.

5. A folding box package according to claim 1, characterized in that the perforation is a cut perforation.

* * * * *